US005197638A

United States Patent [19]

Wood

[11] Patent Number: 5,197,638

[45] Date of Patent: Mar. 30, 1993

[54] SELF SEALING PRODUCT DELIVERY SYSTEM

[75] Inventor: Robert Wood, Garden Grove, Calif.

[73] Assignee: Allergan, Inc., Irvine, Calif.

[21] Appl. No.: 785,588

[22] Filed: Oct. 30, 1991

[51] Int. Cl.[5] ..... B65D 37/00

[52] U.S. Cl. ..... 222/212; 222/496; 239/533.1; 239/570; 137/510

[58] Field of Search ..... 222/494–497, 222/212, 213, 518; 239/533.1, 533.15, 570, 583; 137/510

[56] References Cited

U.S. PATENT DOCUMENTS

| | | | |
|---|---|---|---|
| 2,140,247 | 12/1938 | Pazdernick | 222/496 |
| 2,170,588 | 8/1939 | Douglas | 222/496 |
| 2,362,102 | 11/1944 | Simon | 239/533.1 X |
| 2,384,679 | 9/1945 | Holtzclaw | 239/533.1 X |
| 2,825,602 | 3/1958 | Rabbitt | 239/533.15 X |
| 2,830,733 | 4/1958 | Garibaldi | 222/496 X |
| 3,305,134 | 2/1967 | Carmichael et al. | 222/494 X |
| 3,393,873 | 7/1968 | Larson | 239/583 X |
| 3,474,936 | 10/1969 | McDonnell | 239/327 X |
| 3,515,316 | 6/1970 | Green | 222/213 X |
| 3,650,473 | 3/1972 | Malone | 239/333 |
| 3,753,642 | 8/1973 | Lamoureux | 239/570 X |
| 3,913,804 | 10/1975 | Laauwe | 239/533.15 X |
| 4,077,569 | 3/1978 | Deines | 239/533.15 X |
| 4,223,842 | 9/1980 | Hayes | 239/327 |
| 4,313,568 | 2/1982 | Shay | 239/533.1 X |
| 4,415,122 | 11/1983 | Laauwe | 239/327 |
| 4,506,809 | 3/1985 | Corsette | 222/494 X |
| 4,723,725 | 2/1988 | Comment | 239/533.1 |
| 4,785,978 | 11/1988 | Kano | 222/496 X |
| 4,798,311 | 1/1989 | Workum | 222/496 X |
| 5,042,697 | 8/1991 | Warren | 222/402.1 |

*Primary Examiner*—Kevin P. Shaver
*Attorney, Agent, or Firm*—Spensley Horn Jubas & Lubitz

[57] ABSTRACT

A nozzle for dispensing a product while perserving the sterility of the product remaining in storage incorporates a mechanism which combines a flexible static seal and a valve. The valve moves as the static seal is deflected to open an orifice allowing the stored product to be expelled into the air. The seal is deflected sufficiently to open the valve only when the pressure behind the seal is great enough to force flow from the product container to the atmosphere. If the pressure in the sterile container is lower than the ambient pressure, which would permit a flow of air and microbiological contaminants into the container, then the static seal, with the help of a spring, is deflected to force the valve to close.

5 Claims, 4 Drawing Sheets

SELF SEALING PRODUCT DELIVERY SYSTEM

FIELD OF THE INVENTION

The present invention relates to a product delivery nozzle, and in particular to one in which the product is sterile and must be protected from microbiological contamination before delivery.

RELATED ART

Many applications call for the controlled delivery of an aliquot of sterile solution from a relatively large storage container while preserving the sterility of the remaining contents of the container. Examples where there is a need for such a delivery system are found in the areas of medicine, applying contact lens solution, biological experiments, chemistry and the like.

Self-activating nozzles are referred to in U.S. Pat. Nos. 4,223,842, 4,785,978, 3,650,473, 4,506,809, 4,415,122, 3,474,936, 2,140,247, 2,830,733 and 4,313,568, all of which are incorporated herein by this reference. These patents, however, do not prevent ambient air from entering the storage container and therefore do not meet the present invention's objective of preserving sterility within the container.

U.S. Pat. Nos. 4,723,725 and 2,170,588 are also of pertinence and are incorporated herein by reference. Courgenay U.S. Pat. No. 4,723,725 uses a tandem set of dynamic seals which offer much higher resistance and less security against microbiological invasion than the present invention. Douglas U.S. Pat. No. 2,170,588 discloses a dynamic seal having a spring loaded piston valve which is solid and not integrated into a flexible diaphragm. The significance of this is that some clearance must be provided between the piston and nozzle wall and this clearance will allow microbiological contaminants to flow from the atmosphere into the storage container.

The problem of providing a discharge nozzle which preserves an environment free of undesired microbiological organisms within a product storage container has presented a challenge to designers. The development of a nozzle which allows an aliquot of a sterile product to be dispensed without allowing microbiological contamination of the remainder of the product would represent a major advance in sterile product handling technology and would satisfy a long felt need in the field of sterile product dispensers.

SUMMARY OF THE DISCLOSURE

The present method for dispensing sterile products solves the above referenced problems and satisfies the noted needs. The present invention offers a simple solution to the problem of keeping bacterial or other biologic contaminants from entering a storage container while allowing the contents of the container to be dispensed to the atmosphere.

The basis of the present invention is that a diaphragm, acting as a static seal, separates a plenum of sterile liquid, gas or solid from the environment. An exit valve, which can create a hermetic seal between the sterile product and the outside environment, is attached to the diaphragm and pressure induced deflections of the diaphragm cause the exit valve to open and close.

These and other features, aspects, and advantages of the present invention will become better understood with reference to the following description, appended claims, and accompanying drawings.

DRAWINGS

FIG. 1a is a sectional view of one embodiment of the delivery nozzle showing the nozzle head and tail, spring, piston and integral diaphragm, inlet, outlet, atmospheric bleed hole and various internal orifices. A representative cutaway section of a s flexible sterile product container is shown surrounding the nozzle inlet. Section 1—1, views (b) through (f) indicate alternative embodiments of the diaphragm to nozzle body interface.

Figure 5A:
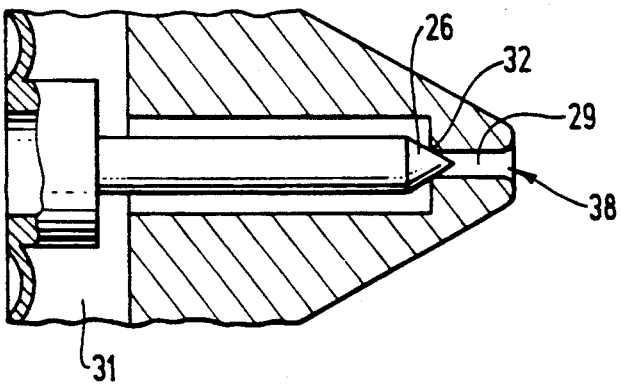
Figure 5B:
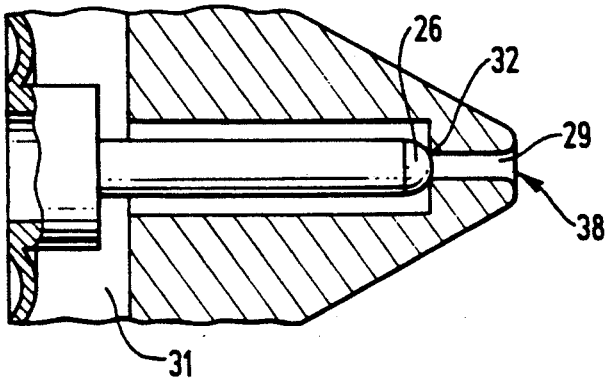

FIG. 5, views (a) and (b) are two alternative embodiments of how the piston and annular sealing surface may interact to seal the sterile product from unwanted biological contaminants.

DETAILED DESCRIPTION OF THE PREFERRED EMBODIMENTS

With reference to FIG. 1, a sectional view of the product delivery nozzle 10 is shown attached to a cutaway section of a sterile product reservoir 40. The nozzle 10 is manufactured by attaching two structural sections, the nozzle tail 12 and the nozzle head 14, to each other. When the nozzle tail 12 and nozzle head 14 are attached the Visible exterior portion defines an external surface 15.

The nozzle tail 12, in the preferred embodiment, is a cylinder having a hollow interior 33, closed at one end 35 and adapted to mate with the nozzle head 14 at the open end 37 through engagement means 36 for engaging the nozzle head 14. A preferred engagement means 36 involves two mating threaded surfaces. Other embodiments use press fits, pin and detent arrangements, bonding, gluing, brazing or welding as engagement means 36.

The preferred nozzle tail 12 has a spring centering knob 18 centrally located on the interior of the closed end 35. An atmospheric vent 16 allows air to pass into and out of the nozzle's atmospheric chamber 33 even when the open end 37 is sealed.

The nozzle head 14 is generally conical in the preferred form and has an narrow outlet 38 passing through its apex and widening, along the conical axis, toward the base to form a hollow nozzle outlet chamber 29 and a nozzle inlet chamber 31. As outlet 38 widens, a discreet step forms an annular sealing surface 32. The annular sealing surface 32 is a sharp corner or edge in the preferred embodiment and defines the boundary between the nozzle outlet chamber 29 and the nozzle inlet chamber 31.

Inlet orifice 24 passes through an inlet tube 22 which is preferably integrated into the nozzle head 14. When there is no obstruction at the sealing surface 32, material can pass freely from the inlet 24 to the outlet 38.

The preferred material for the nozzle tail 12 and head 14 is polyvinylchloride. Other materials include polyethylene and polypropylene.

Figure 1A:
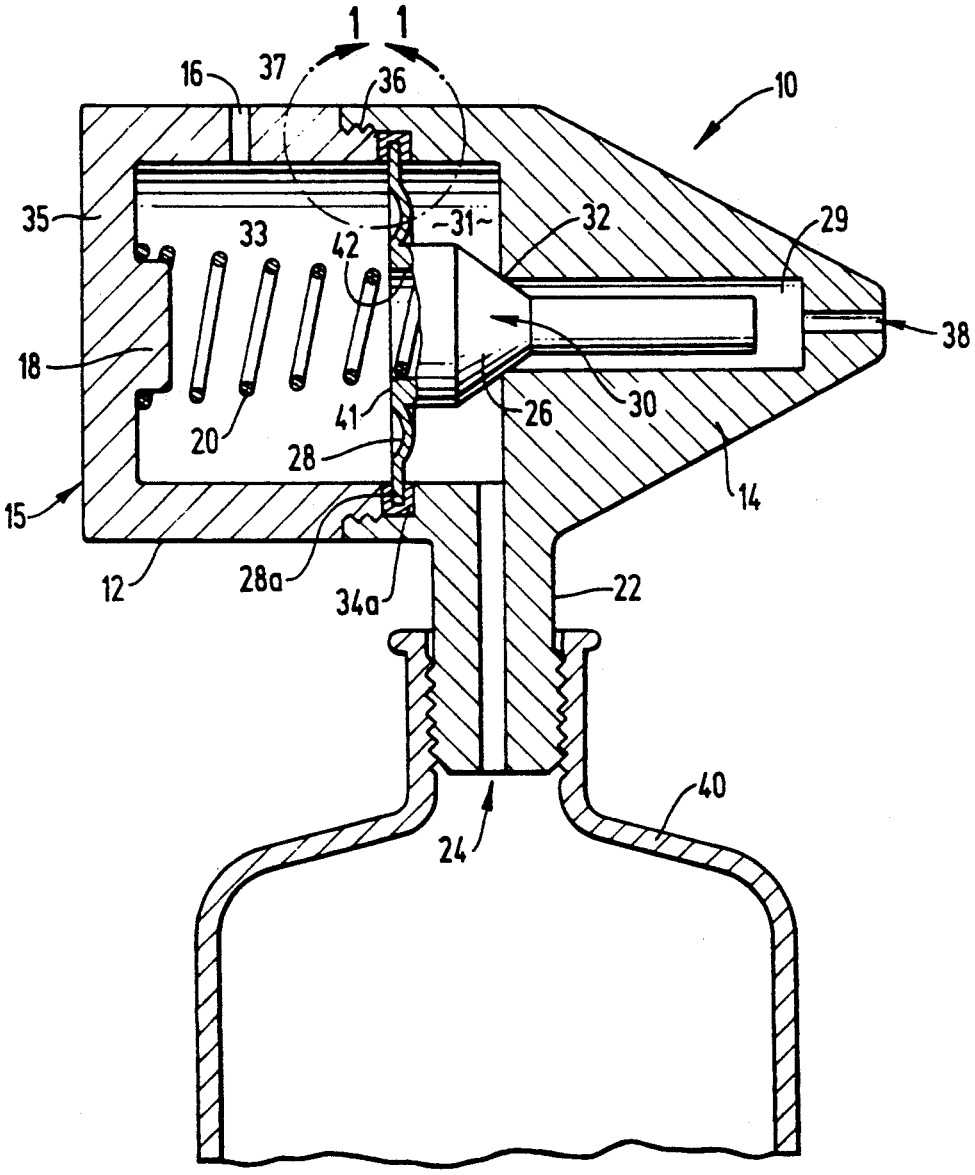
Figure 1B:
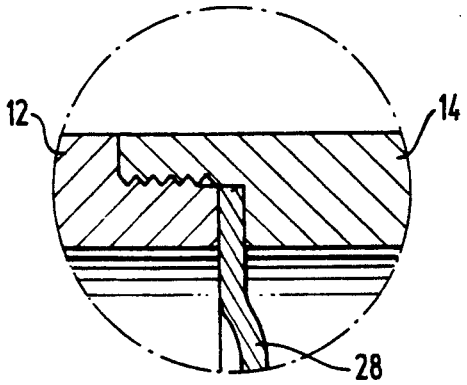
Figure 1C:
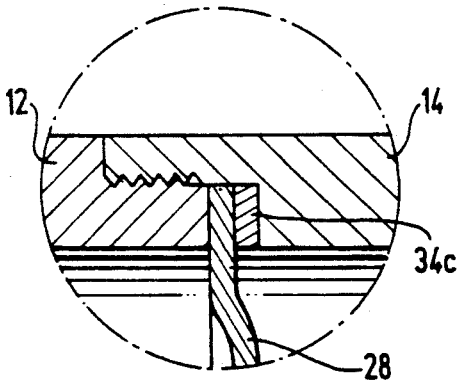
Figure 1D:
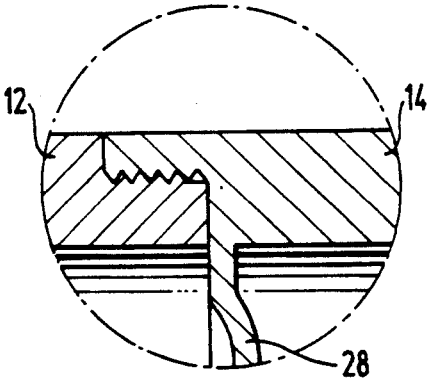
Figure 1E:
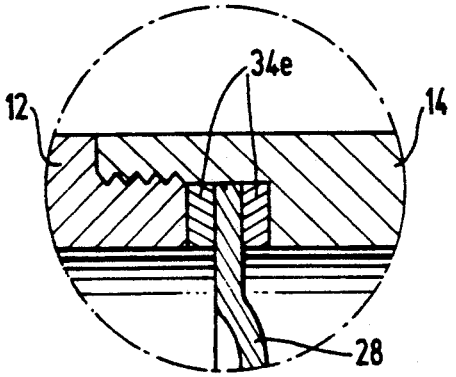
Figure 1F:
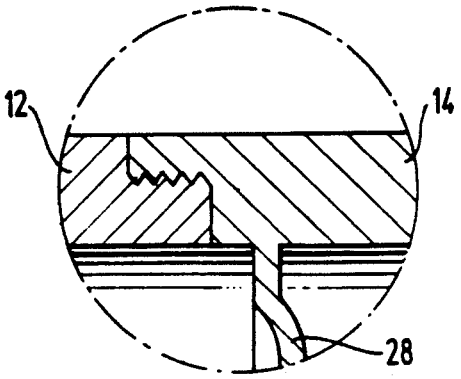
Figure 2:
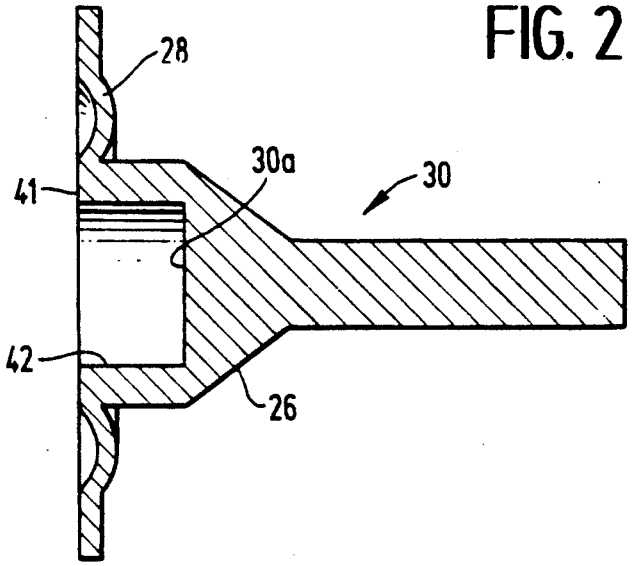
FIG. 2 is a sectional view of one embodiment of the piston and diaphragm. The sealing surface of the piston and the spring indent in the piston's diaphragm end are depicted.

With reference also to FIG. 2, a piston 30 is formed such that a flexible diaphragm 28 extends radially outward from the piston's central axis at the piston's base end 41. Preferably the piston and diaphragm are integrally formed.

A portion of the piston 30 is tapered to form a sealing surface 26. This sealing surface 26 is dimensioned to engage and form a seal against air and microbiological contaminants with the annular sealing surface 32 of the nozzle head 14. In the preferred embodiment, the sealing surface 26 is generally conical. Alternative designs allow for the sealing surface 26 to be partially spherical or have other geometries capable of creating an adequate seal between the surfaces 26 and 32. The piston sealing surface 26 may be either rigid or compliant with respect to the annular sealing surface 32.

In the preferred embodiment, the nozzle head 14 and nozzle tail 12 are firmly connected along a mating surface 36 while clamping the diaphragm 28 on two surfaces between a compliant seal 34*a*. This provides a static flexible seal between the nozzle head 14 and tail 12 where the contact area between the diaphragm 28, compliant seal 34*a*, nozzle head 14 and nozzle tail 12 remains fixed. Alternative embodiments allow the diaphragm 28 and the nozzle head 14 to be manufactured as one piece with the nozzle tail 12 attached to the nozzle head 14 during assembly. Other embodiments use single contact surface compliant seals, either alone in 34*c* or in pairs 34*e*.

A spring 20 is compressed between the closed end of the nozzle tail 35 and the opposing surface 30*a* of the piston spring indent 42. Spring 20 exerts an axial force along the piston 30 and drives the piston sealing surface 26 intimately into the outlet sealing surface 32 to form a hermetic seal. The stiffness of the spring is chosen such that a pressure, resulting from the reservoir 40 being squeezed by hand, transmitted through the inlet 24, to the chamber 31, and acting on the diaphragm 28, will cause the spring 20 to deflect and break the seal between the piston surface 26 and nozzle surface 32.

When the reservoir 40 is not squeezed, the spring 20 forces a seal between the piston surface 26 and the outlet surface 32. This arrangement allows the inlet 24 to be a passage to the outlet 38 only while the reservoir 40 is being squeezed and the reservoir contents create sufficient pressure against the diaphragm 28 to overcome the force of the spring 20. In such case, the contents of the reservoir 40 will pass through the inlet 24 and the outlet 38 into the atmosphere or wherever directed.

Section 1—1, sectional views (b) through (f), show the following alternate embodiments for the interface between the diaphragm 28, the nozzle head 14 and nozzle tail 12: (b) diaphragm 28 is compressed directly between the nozzle head 14 and tail 12, (c) a compliant annular seal 34*c* is sandwiched between the nozzle head 14 and the diaphragm 28, (d) the diaphragm 28 is integral to the nozzle head 14 and is contacted by the nozzle tail 12, (e) a pair of compliant seals 34*e*, in series, are compressed between the diaphragm 28 and, one between the nozzle head 14 and, one between the nozzle tail 12, and (f) the diaphragm 28 is integral to the nozzle head 14 and at a position such that the nozzle tail 12 and the diaphragm 28 do not contact each other.

With reference to FIG. 2 a sectional view of the piston 30 and diaphragm 28 is shown. The conical sealing surface 26 is depicted as well as a spring indent 42 in the piston 30. The indent 42 is preferably axially centered on the piston base 41 of the piston 30 and holds the spring 20 while directing the spring force evenly along the annular contact area between the piston surface 26 and the sealing surface 32.

The preferred material for the construction of the piston 30 and the diaphragm 28 is polyethylene (low or high density). Other materials include polypropylene, polyethylene terephtalate, vinyl, urethane, silicone, neoprene, fluro polymer, natural latex, any thermoplastic elastomer, acrylonitrile, acrylonitrilebutadiene-styrene polycarbonate, polyurethane, polyvinyl-chloride, acetal, acrylic, polymethylmethacrylate, fluoropolymers, nylon, teflon, polysulfone, polyester, polypropylene, ethylene-vinylacetate, polystyrene and styrene-acrylinytrile.

The piston 30 and diaphragm 28 may be formed as an integral unit or formed separately, then joined using welding, ultrasonic and/or a glue bonding method. Other options include a compression seal using compressible gaskets or the pliable material of the diaphragm without additional gasketing. The diaphragm 28 may also be fabricated of a compliant material such as medical grade silicone molded to a piston 30 of plastic.

Figure 3:
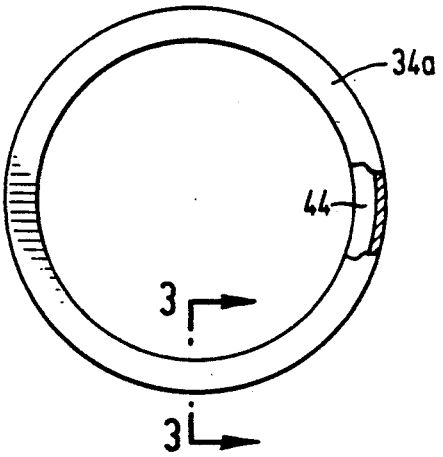
FIG. 3 is a plane view of one embodiment of the compliant seal used in one embodiment of the invention. Sectional views showing alternative embodiments of the compliant seal are given in section 3—3, FIGS. 3(a) through (c).
Figure 3:
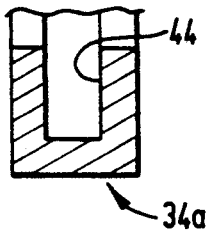
Figure 3:
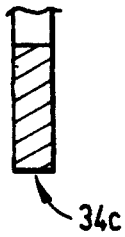
Figure 3:
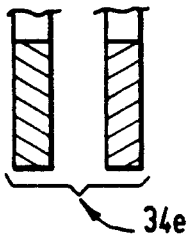

Attention is drawn to FIG. 3 which depicts a compliant seal 34*a* which is used in the preferred embodiment of the invention. In this preferred embodiment, the seal 34*a* having a slot 44 envelops the diaphragm edge 28*a* preventing intimate contact between the diaphragm edge 28*a* and either the nozzle head 14 or tail 12. The compliant seal 34*a* will be sufficiently compressed to effect an interface impermeable to air and microbiological forms. The seal can be manufactured of a sterile material which is inert in the presence of any of the materials which are expected to contact it. A single annular seal 34*c*, or a pair of annular seals in series 34*e*, may also prove satisfactory for preventing the passage of microbiological life and air from the atmospheric chamber 33 to the inlet chamber 31. Preferred material for the compliant seal 34 is the diaphragm material. Alternatives would be: silicone, butal, viton, buna-n and natural latex.

Other embodiments of the present invention include a permanent bonding or fusion of the diaphragm 28 to the nozzle head 14 to form a hermetic seal against biological forms or the elimination of seal 34. Examples of alternative embodiments, including diaphragms 28 fused to the nozzle head 14 are noted in FIG. 1 above.

Figure 4:
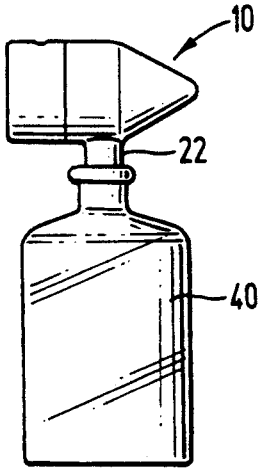
FIG. 4 is a view of the nozzle system as connected to a squeezable bottle.

FIG. 4 is a view of the complete nozzle 10 mated with a typical product reservoir 40. The reservoir 40 may be integral to the nozzle assembly 10 or removably attached to the inlet tube 22. The seal between the reservoir 40 and the nozzle 10 should be able to withstand more pressure than is required to deflect the diaphragm 28.

The nozzle 10 is designed to operate with a wide variety of sizes and shapes of reservoirs 40. Preferably, the reservoir 40 can be deformed, reversibly or otherwise, sufficiently to create the necessary pressure to open the valve interface between piston surface 26 and sealing surface 32. Typical product reservoirs 40 include commercial contact lens solution bottles, antibacterial disinfectant squeeze tubes and ophthalmic solution containers.

With reference to FIG. 5, two alternate embodiments of the piston sealing surface 26 as it interacts with the annular sealing surface 32 are shown. The alternate embodiment (a) has the same elements as the preferred embodiment in FIG. 1 except that the annular sealing surface 32 is located adjacent to the outlet 38 and there is a volumetric reduction in the outlet chamber 29. Alternate embodiment (b) utilizes a rounded, rather than conical, piston sealing surface 26, yet otherwise is similar to alternate embodiment (a). In the (a) and (b) embodiments the outlet chamber 29 can be eliminated without affecting the function of the nozzle 10.

Thus generally the present invention is directed to a nozzle having a body having first, second and third chambers; a flexible diaphragm; a piston having a base, the piston base being connected to the diaphragm, the piston base and diaphragm hermetically separating the first and the second chambers, wherein the piston is moveable into two positions, in a closed position the piston hermetically separates the second and third chambers and in an open position the second and third chambers are in flow communication with each other. Preferably, a portion of the surface of the body defining the second and third chambers is a sharp edge and the piston includes a beveled surface, wherein in the closed position the edge is in intimate contact with the beveled surface. Preferably still, a spring is disposed between the piston base and an interior portion of the body, the spring biasing movement of the piston from the open position to the closed position.

In general, a product reservoir is in flow communication with the second chamber. Pressure applied within the inlet chamber causes the diaphragm to deflect and moves the piston into the open position. Preferably the first chamber has an atmospheric vent which maintains the first chamber at a pressure equivalent to the pressure on an outer surface of the nozzle.

Another general aspect of the present invention is concerned with a method for dispensing a sterile material through a nozzle. The steps of the method include applying pressure against a flexible diaphragm; moving a surface connected to the diaphragm from hermetic engagement with an internal surface of the nozzle; and delivering the material between the surface connected to the diaphragm and the internal surface. Preferably the method also includes removing pressure against the flexible diaphragm and moving the surface connected to the diaphragm into hermetic engagement with the internal surface of the nozzle. The method further preferably includes the step of attaching a reservoir of sterile material to the nozzle and applying pressure to the reservoir.

The invention now being fully described, it will be apparent to one of ordinary skill in the art that many changes and modifications can be made without departing from the spirit or scope of the invention.

What is claimed is:

1. A self-sealing nozzle assembly in combination with a manually squeezable container which receives sterile product from said manually squeezable container and to dispense such sterile product, the nozzle assembly comprising:

a nozzle assembly body defining first, second and third chambers, an inlet and an outlet, the inlet being in communication with the second chamber and coupled to said squeezable product container, the outlet providing communication between the third chamber and ambient atmosphere, and the second and third chambers defining between them a first sealing surface;

a flexible diaphragm;

a piston having a base connected to the diaphragm, the piston base and diaphragm hermetically separating the first and second chambers, said piston defining a second sealing surface adapted to engage the first sealing surface, engagement of said sealing surfaces hermetically sealing the second chamber from the third chamber and disengagement of said sealing surfaces bringing the second and third chambers into communication with each other; and a compression spring enclosed in said first chamber and coupled to the piston base for resiliently biasing the piston toward said outlet to a position in which said sealing surfaces are in engagement, said sealing surfaces being disengaged in response to the admission of product into the second chamber under sufficient pressure to overcome the bias of said compression spring thereby permitting product to flow from said second chamber into said third chamber and to be discharged from said outlet at a flow rate dependent upon the magnitude of the manual pressure applied to the squeezable container.

2. A self sealing nozzle assembly, as defined in claim 1, in which:

the first chamber is vented to ambient atmosphere.

3. A self-sealing nozzle assembly, as defined in claim 1, in which:

the nozzle assembly is made of plastic;

the first sealing surface comprises a sharp-edged annulus; and the second sealing surface comprises a conical surface on the piston converging toward said outlet.

4. A self-sealing nozzle assembly, as defined in claim 1, in which:

the nozzle assembly body comprises a first half defining the first chamber and a second half defining the second and third chambers, the flexible diaphragm having a periphery clamped between the first and second body halves.

5. A self-sealing nozzle assembly, as defined in claim 4, in which:

the first and second body halves are threadedly coupled to each other.

* * * * *

UNITED STATES PATENT AND TRADEMARK OFFICE

CERTIFICATE OF CORRECTION

PATENT NO. : 5,197,638

DATED : March 30, 1993

INVENTOR(S) : Robert Wood

It is certified that error appears in the above-indentified patent and that said Letters Patent is hereby corrected as shown below:

Column 2, line 36, "Visible" should read --visible--.

Signed and Sealed this

Fourth Day of October, 1994

*Attest:*

*Attesting Officer*

BRUCE LEHMAN

*Commissioner of Patents and Trademarks*